US005943696A

United States Patent [19]

Walker

[11] Patent Number: 5,943,696

[45] Date of Patent: Aug. 31, 1999

[54] PAINTER'S GARMENT

[76] Inventor: Joseph W. Walker, 2634 Thomasville Rd., Winston-Salem, N.C. 27107

[21] Appl. No.: 08/968,486

[22] Filed: Nov. 12, 1997

[51] Int. Cl.[6] ..... A41B 13/10

[52] U.S. Cl. ..... 2/51; 224/904

[58] Field of Search ..... 2/51, 48, 52, 22, 2/94; 474/130; 224/904, 195, 660, 661, 663, 664, 665, 666, 667, 668, 669, 671, 672, 674, 675, 676, 677, 682, 268, 269, 270

[56] References Cited

U.S. PATENT DOCUMENTS

| | | |
|---|---|---|
| 2,169,080 | 8/1939 | Clark . |
| 2,441,115 | 5/1948 | Lambert . |
| 2,785,409 | 3/1957 | Lackey . |
| 2,945,614 | 7/1960 | Wittmann . |
| 2,987,231 | 6/1961 | Lewis . |
| 3,212,690 | 10/1965 | Green . |
| 3,285,482 | 11/1966 | Bedsaul . |
| 3,493,152 | 2/1970 | Ort . |
| 3,535,709 | 10/1970 | Johannes . |
| 4,325,503 | 4/1982 | Swinney . |
| 5,016,791 | 5/1991 | Burow . |
| 5,163,591 | 11/1992 | Leiserson et al. . |
| 5,341,975 | 8/1994 | Marinescu . |
| 5,385,281 | 1/1995 | Byrd . |
| 5,490,618 | 2/1996 | Davidson . |
| 5,497,921 | 3/1996 | Dancyger et al. . |
| 5,566,391 | 10/1996 | Williamson . |
| 5,609,283 | 3/1997 | Harrison . |
| 5,687,892 | 11/1997 | Johns . |
| 5,695,104 | 12/1997 | Darling . |

*Primary Examiner*—John J. Calvert
*Assistant Examiner*—Shirra L. Jenkins
*Attorney, Agent, or Firm*—Rhodes & Mason, P.L.L.C.

[57] ABSTRACT

A painter's garment for supporting on a wearer a prescribed paint supply container of the type having a handle and a prescribed paint application tool of the type having an opening. The garment includes a belt for mounting the garment on the wearer. An apron is secured to and depends from the belt. The apron has a front face. A first connector is secured to the apron for engaging and removably holding the handle of the container. A second connector is secured to the apron for engaging and removably holding the paint application tool. The first and second connectors and the apron are relatively arranged and configured such that when the container handle is suspended from the first connector and the paint application tool is supported from the second connector, the container is disposed adjacent the apron and the paint application tool is positioned over or within the container.

9 Claims, 3 Drawing Sheets

PAINTER'S GARMENT

FIELD OF THE INVENTION

The present invention relates to means for supporting painting tools and supplies, and, more particularly to a garment for carrying a paint supply container and a tool for applying paint.

BACKGROUND OF THE INVENTION

A painter must have both a supply of paint (e.g., a paint can) and a tool for applying the paint (e.g., a paintbrush, roller, or sponge pad), each immediately accessible at the location to be painted.

A surface to be painted may be accessible from the ground, in which case the paint supply may be placed on the ground, requiring the painter to repeatedly stoop to reapply paint to the application tool. Such movement is both inefficient and potentially messy as it requires that the paint-laden tool travel a relatively long distance over which it may drip paint. The container may be placed on a stool or other support. However, the support may not be sufficiently stable and, in any event, the support must be repeatedly moved as the painter travels along the surface to be painted.

Very often, it is necessary for the painter to climb a ladder or scaffolding to access surfaces to be painted. Again, the paint supply and tool must be readily accessible. The ladder or scaffolding may be unstable so that placement of the paint container on the ladder or scaffolding risks spilling the paint. Moreover, it is often necessary for the painter to have one or both hands free to ascend and descend the ladder or scaffolding, although the paint supply and tool must somehow be carried up the ladder or scaffolding.

Very often, tools other than paint application tools are needed at the location to be painted. For example, a caulk gun or scraper tool may be needed to prepare the surface for painting. It is desirable that these items be kept close at hand so that they may be accessed as needed.

Thus, there exists a need for a means for supporting a paint supply and a paint application tool such that the paint and tool are readily accessible and may be transported with the painter, while at the same time allowing the painter the use of both hands as needed.

SUMMARY OF THE INVENTION

The present invention is directed to a painter's garment for supporting on a wearer a prescribed paint supply container of the type having a handle. The garment includes a belt for mounting the garment on the wearer. An apron is secured to and depends from the belt. The apron has a front face. A connector is secured to the apron for engaging and removably holding the handle of the container. The connector and the apron are relatively arranged and configured such that when the container handle is suspended from the first connector, the container is disposed adjacent the apron.

Preferably, the connector includes a hook member. More preferably, the connector includes a clip including the hook member and a latch arm.

A tool pouch may be secured to the front face of the apron, the tool pouch adapted to receive and hold a tool. In addition or alternatively, a tool pouch may be mounted on the belt and separate from the apron, the tool pouch adapted to receive and hold a tool. The tool pouch mounted on the belt may be slidably mounted on the belt.

In a preferred embodiment, the belt includes releasable coupling means for releasably securing the belt about the torso of the wearer. The belt may be length adjustable to accommodate wearers of different sizes.

Preferably, the apron has a length extending below the belt from about 15 to 19 inches and a width extending along the belt from about 15 to 19 inches.

In a preferred embodiment, the present invention is directed to a painter's garment as described above which is further adapted for supporting on a wearer a prescribed paint application tool of the type having an opening. The garment further includes a second connector secured to the apron for engaging and removably holding the paint application tool. The first and second connectors and the apron are relatively arranged and configured such that when the container handle is suspended from the first connector and the paint application tool is supported from the second connector, the container is disposed adjacent the apron and the paint application tool is positioned over or within the container. Preferably, the second connector includes a hook member.

DETAILED DESCRIPTION OF THE PREFERRED EMBODIMENT

Figure 1:
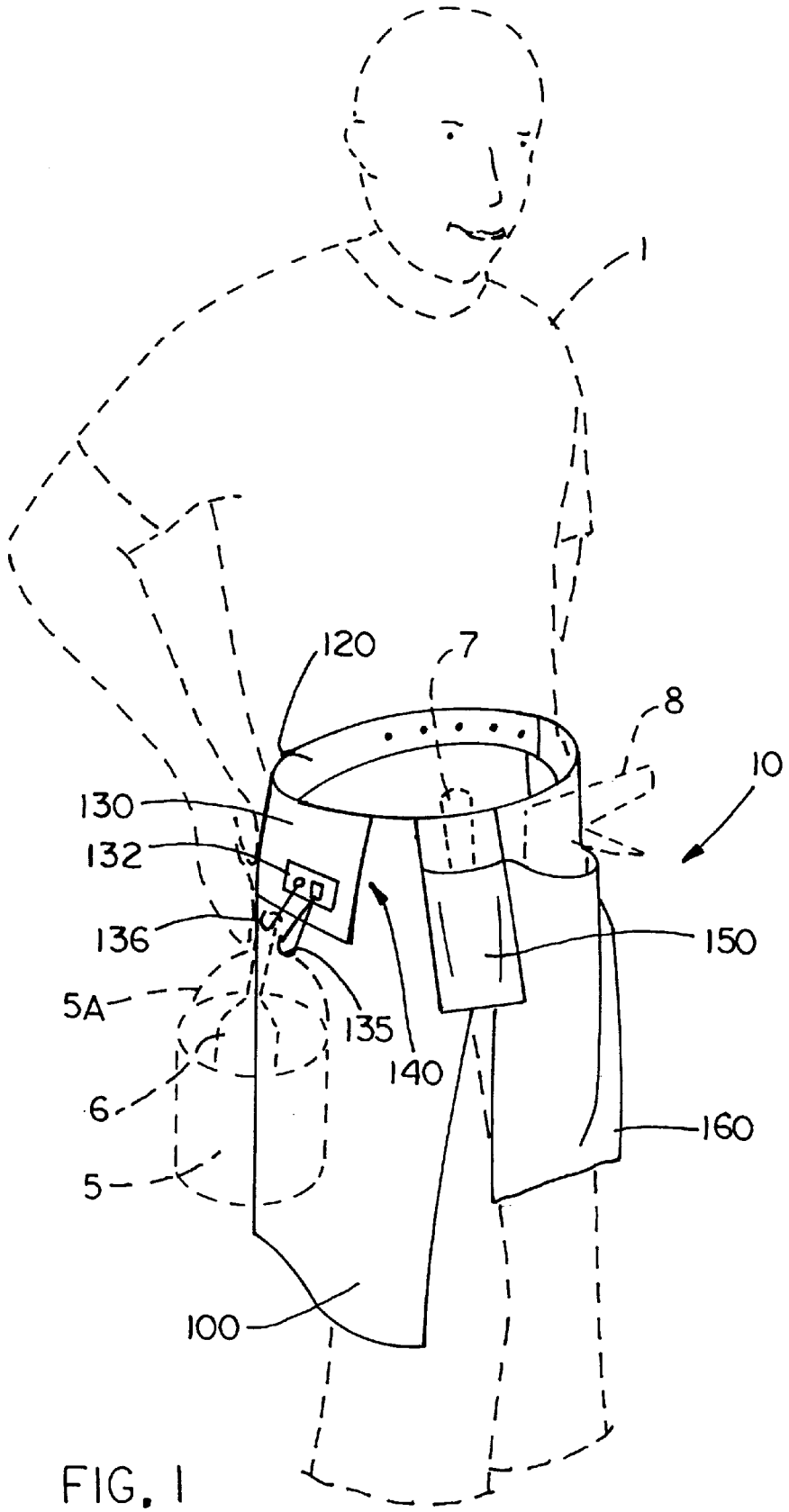
FIG. 1 is a perspective view of a painter's garment according to the present invention in use as worn about the torso of the wearer.

With reference to FIG. 1, the painter's garment according to the present invention is shown therein and generally denoted by the numeral 10. Painter's garment 10 is adapted to be worn about the torso of a wearer 1. Painter's garment 10 conveniently holds paint supply container 5, paint application tool 6, a first tool or scraper 7, and a second tool or caulk gun 8. Paint supply container 5 may be, for example, a one gallon canister of the type in which paint is commonly supplied. Paint application tool 6 as shown is a paint brush, however, it will be appreciated that rollers, sponge pads, and other type paint application tools may be used with the present invention as well.

Painter's garment 10 holds container 5 by means of snap hook or clip 135 into which handle 5A is inserted, the wearer being protected from container 5 by apron 100. Brush 6 is supported by the painter's garment by J-hook 136 which extends through eyelet 6A of the brush, paint application tools typically being provided with such eyelets or suspension hooks. Tools 7 and 8 are held by pouches 150 and 160, respectively, such that they are readily accessible but do not inhibit movement of wearer 1.

Figure 2:
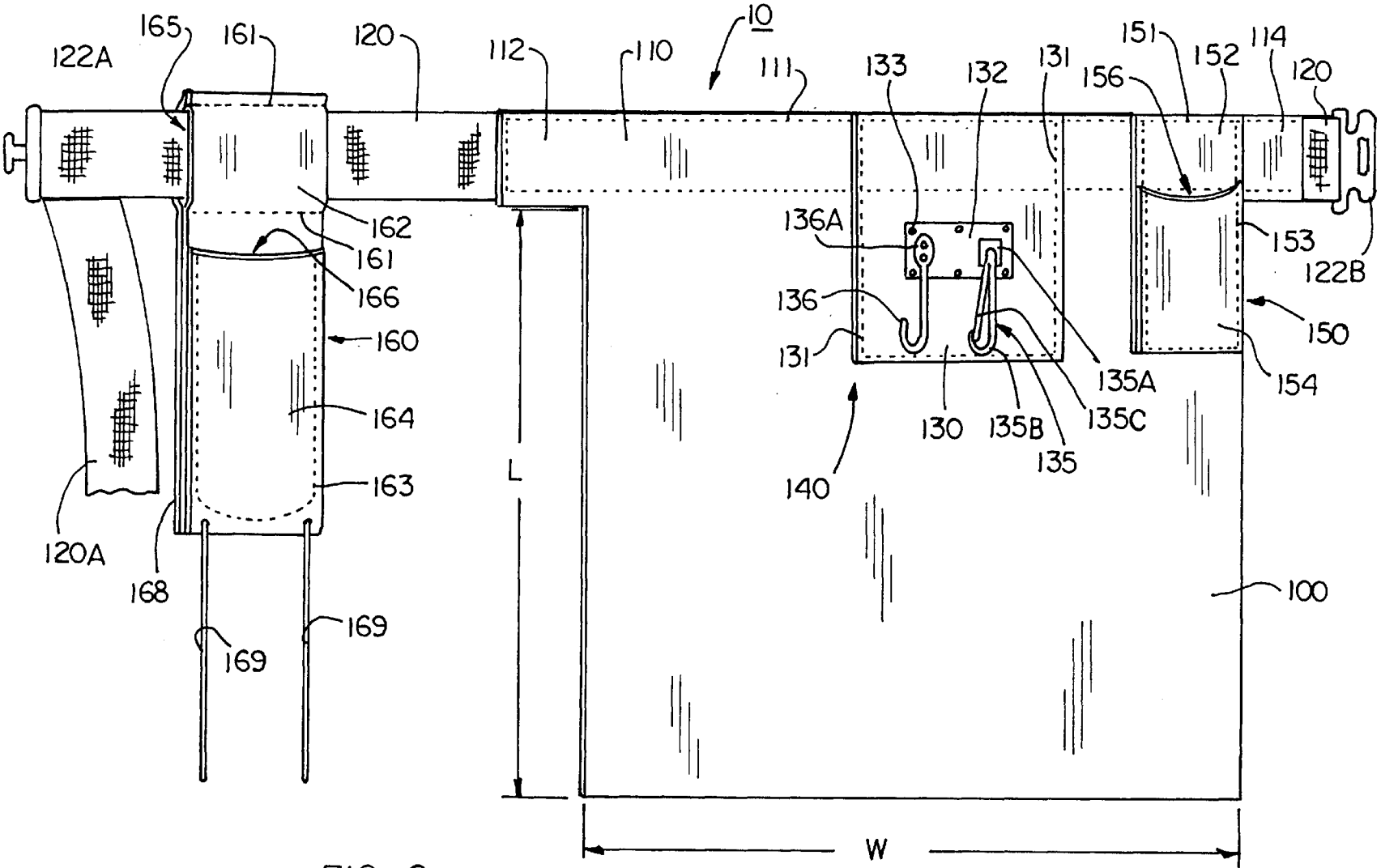
FIG. 2 is front, plan view of the painter's garment.

With reference to FIG. 2, apron 100 is secured to belt 120 by stitching 111 along top margin 110 of the apron. Opposed, integral extensions 112, 114 extend from either side of apron 100 and serve to better distribute the load of the paint supply. Cooperative buckles or other suitable fastening means 122A, 122B are provided on the ends of belt 120. Buckle 122A is length adjustably mounted on belt 120, with an extra length of belt 120A being provided for lengthening belt 120 to accommodate wearer's of different sizes. Apron 100 is preferably formed of leather. Vinyl may also be used. Apron 100 preferably has a length L of from about 15 to 19 inches, and more particularly of from about 17 to 19 inches, and a width W of from about 15 to 19 inches, and more preferably of from about 17 to 19 inches. Dimensions L and W are preferably the same. Belt 120 is preferably formed of fabric.

Belt 120 is preferably from about 3 to 4 inches wide, and from about 44 to 46 inches long. It will be appreciated that other suitable materials may be used to form the apron and belt, as well.

Support assembly 140 which holds paint supply 5 and paintbrush 6 includes reinforcement panel 130, mounting plate 132, clip 135 and hook 136. Reinforcement panel 130 is secured to the front of apron 100 and belt 120 by stitching 131. Reinforcement panel 130 is preferably formed from the same materials as apron 100. Mounting plate 132 is secured to apron 100 and reinforcement panel 130 by rivets 133 or other suitable fastening means. Mounting plate 132 is preferably formed of metal. A first connector in the form of a clip a first 135 having J-Hook member 135B and latch arm 135C is mounted on plate 132 by connector 135A which allows clip 135 to pivot about a horizontal axis. Latch arm 135C is preferably spring biased into a closed position. A second connector in the form of a second hook 136 is mounted on plate 132 along with clip 135 by rivets 136A or other suitable fastening means. Clip 135 and hook 136 are preferably formed of metal. Clip 135 and hook 136 are each preferably from about 2 to 3 inches long and more preferably about 2⅞ inches long.

A first tool pouch 150 includes first panel 152 secured only by the upper end thereof to portion 110 of apron 100 by stitching 151. Second panel 154 is secured to panel 152 by stitching 153 to form a pocket with top opening 156. Panels 152 and 154 are preferably formed of the same materials as apron 100. Tool pouch 150 may be positioned on the other side of apron 100 (i.e., adjacent extension 112) so that it is positioned behind the wearer when the garment is worn.

A second or caulk gun pouch 160 has first panel 162 and second panel 168 secured together by stitching 161 on either side of belt 120 to define loop 165. Pouch 160 is slidable along the length of belt 120 which extends through loop 165. Rather than being slidably mounted on belt 120, caulk gun pouch 160 may be fixably secured to belt 120 by positioning stitching 161 so that it extends through belt 120 as well. Pocket panel 164 is secured to the front of panel 162 by stitching 163 and defines a pocket with top opening 166. Stitching 163 also extends through panels 162 and 168 to join the panels. Cords 169 are provided on the lower corners of pouch 160 and are of suitable length to allow the wearer to tie the cords about his leg to secure the end of pouch 160, if desired. Panels 162, 164, and 168 are preferably formed from the same materials as apron 100.

Figure 3:
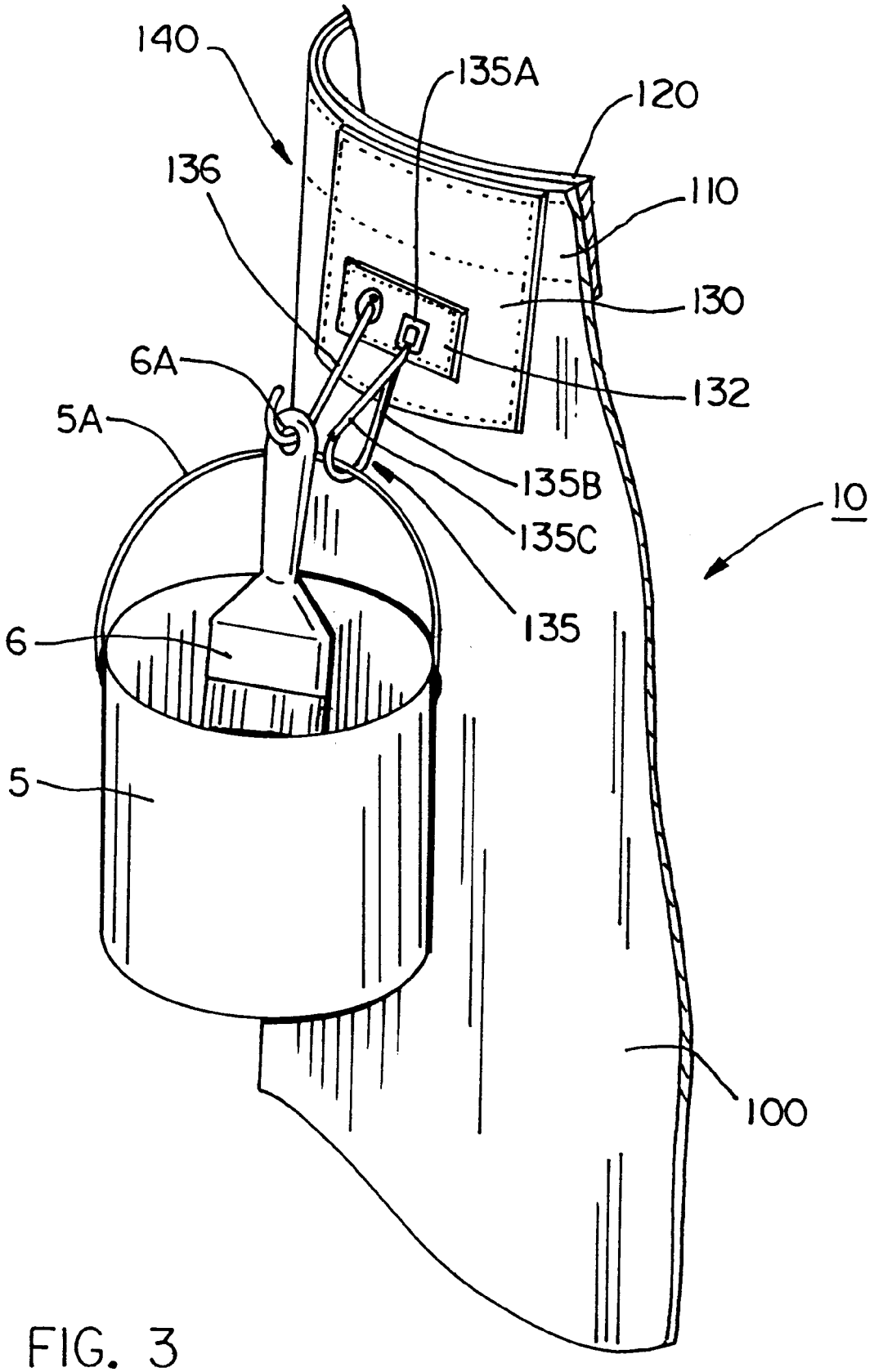
FIG. 3 is a fragmentary, perspective view of the painter's garment.

FIG. 3 shows support assembly 140 and apron 100 and their preferred use with container 5 and paint application tool 6 in greater detail. Paint container 5 is suspended from painter's garment 10 by looping handle 5A through clip 135. Handle 5A depends from hook 135B and is prevented from being released from clip 135 by latch arm 135C. Suspended container 5 rests against apron 100 which is backed or supported by the wearer's hip or leg. Brush 6 is suspended by hook 136 which extends though eyelet 6A. Brush 6 depends into container 5 with the handle thereof extending outwardly from the container so that it is easily accessed.

It will be appreciated that the various panels may be secured to one another and to the belt by means other than stitching. For example, rivets or welding may be used. Further, it will be appreciated that pouches 150, 160 may be used for tools other than those described herein and tools of different shapes.

While a preferred embodiment of the present invention has been described, it will be appreciated by those of skill in the art that certain modifications may be made without departing from the scope of the present invention. All such modifications are intended to come within the scope of claims which follow.

What is claimed is:

1. A painter's garment for supporting on a wearer a prescribed paint supply container of the type having a handle and a prescribed paint application tool of the type having an opening, said garment comprising:

a) a belt for mounting said garment on the wearer;

b) an apron secured to and depending from said belt and having a front face;

c) a first connector in the form of a hook member secured to said apron for engaging and removably holding the handle of the container;

d) a second connector in the form of a hook member secured to said apron for engaging and removably holding the paint application tool; and e) wherein said first and second connectors and said apron are relatively arranged and configured such that when the container handle is suspended from said first connector and the paint application tool is supported from said second connector, the container is disposed adjacent said apron and the paint application tool is positioned over or within the container.

2. The garment of claim 1 wherein said first connector comprises a clip including said hook member and a latch arm.

3. The garment of claim 1 including a tool pouch secured to said front face of said apron, said tool pouch adapted to receive and hold a tool.

4. The garment of claim 1 including a tool pouch mounted on said belt and separate from said apron, said tool pouch adapted to receive and hold a tool.

5. The garment of claim 4 wherein said tool pouch is slidably mounted on said belt.

6. The garment of claim 1 wherein said belt includes releasable coupling means for releasably securing said belt about the torso of the wearer.

7. The garment of claim 1 wherein said belt is length adjustable to accommodate wearers of different sizes.

8. The garment of claim 1 wherein said apron has a length extending below said belt from about 15 to 19 inches and a width extending along said belt from about 15 to 19 inches.

9. A painter's garment for supporting on a wearer a prescribed paint supply container of the type having a handle and a prescribed paint application tool of the type having an opening, said garment comprising:

a) a belt for mounting said garment on the wearer, said belt including releasable coupling means for releasably securing said belt about the torso of the wearer and being length adjustable to accommodate wearers of different sizes;

b) an apron secured to and depending from said belt and having a front face, said apron having a length extending below said belt from about 15 to 19 inches and a width extending along said belt from about 15 to 19 inches;

c) a first connector secured to said apron for engaging and removably holding the handle of the container, said first connector comprising a clip including a first hooked member and a latch arm;

d) a second connector secured to said apron for engaging and removably holding the paint application tool, said second connector including a second hook member;

e) a first tool pouch secured to said front face of said apron, said tool pouch adapted to receive and hold a first tool;

f) a second tool pouch slidably mounted on said belt and separate from said apron, said second tool pouch adapted to receive and hold a second tool; and g) wherein said first and second connectors and said apron are relatively arranged and configured such that when the container handle is suspended from said first connector and the paint application tool is supported from said second connector, the container is disposed adjacent said apron and the paint application tool is positioned over or within the container.

* * * * *